US012251640B2

(12) United States Patent
De Cianni

(10) Patent No.: US 12,251,640 B2
(45) Date of Patent: Mar. 18, 2025

(54) PUZZLE CASE

(71) Applicant: Pinnacle Puzzle Pty Ltd, Beverley (AU)

(72) Inventor: Daniel De Cianni, Kent Town (AU)

(73) Assignee: Pinnacle Puzzle Pty Ltd, Beverley (AU)

( * ) Notice: Subject to any disclaimer, the term of this patent is extended or adjusted under 35 U.S.C. 154(b) by 173 days.

(21) Appl. No.: 17/669,496

(22) Filed: Feb. 11, 2022

(65) Prior Publication Data

US 2022/0258040 A1 Aug. 18, 2022

(30) Foreign Application Priority Data

Feb. 18, 2021 (AU) ..... 2021900408

(51) Int. Cl.
*A63F 9/10* (2006.01)
*A63F 9/00* (2006.01)

(52) U.S. Cl.
CPC .... *A63F 9/1044* (2013.01); *A63F 2009/0032* (2013.01)

(58) Field of Classification Search
CPC ..... A63F 9/10; A63F 9/1011; A63F 9/1044; A63F 2003/00372; A63F 2009/0032; A63F 2009/105; A63F 2009/1055
USPC ..... 220/4.01, 4.28, 4.33, 604, 607–608; 206/315.1, 216, 223, 577, 564, 579, 457; 273/157 R, 148 R, 285, 309; D21/480, D21/485
See application file for complete search history.

(56) References Cited

U.S. PATENT DOCUMENTS 1,120,955 A * 12/1914 Martin ..... B65D 5/0005 229/101
1,344,408 A * 6/1920 King ..... A45C 7/00 190/22
1,463,150 A * 7/1923 Carisen ..... A47G 1/143 40/781
1,692,999 A * 11/1928 Siegel ..... A47G 1/06 40/790
2,193,507 A * 3/1940 Carver ..... G09F 13/16 40/596
D124,622 S * 1/1941 Hilton ..... D9/421
(Continued)

FOREIGN PATENT DOCUMENTS

CN 209988303 1/2020
GB 2206807 A * 1/1989 ..... A63F 9/1044
(Continued)

OTHER PUBLICATIONS

AU2022200963_Examination_Report_No. 1—Australian Patent Office, Jan. 7, 2023.

(Continued)

*Primary Examiner* — Chun Hoi Cheung
*Assistant Examiner* — Brijesh V. Patel
(74) *Attorney, Agent, or Firm* — Sand, Sebolt & Wernow Co., LPA

(57) ABSTRACT

A puzzle case that allows for a puzzle to be displayed including a top panel and a base panel that when connected together define a cavity that can hold a puzzle. Typically, each panel comes in four sections that are adapted to be connected and then attached to each other to define a space or cavity to hold a jigsaw puzzle. Mounting points allow for the assembled case to be hung up.

8 Claims, 5 Drawing Sheets

(56) References Cited

U.S. PATENT DOCUMENTS 2,497,341 A 2/1950 Bisson
D173,120 S 9/1954 Levenhagen
2,837,854 A * 6/1958 Bing ..... G03B 21/64 40/706
2,840,257 A * 6/1958 Zeni ..... B65D 21/086 220/8
2,907,487 A * 10/1959 Harrington ..... A47B 88/90 220/8
2,912,137 A * 11/1959 Taylor ..... B65D 90/046 220/651
2,984,489 A * 5/1961 Parlato ..... A63F 9/1044 273/157 R
3,057,624 A 10/1962 Bassett
3,181,869 A * 5/1965 Genin ..... A63F 9/10 40/711
3,339,302 A * 9/1967 Mallory ..... A47G 1/065 40/729
3,371,439 A * 3/1968 Smith ..... G03B 21/64 40/490
3,504,915 A * 4/1970 Walker ..... A63F 9/1044 273/157 R
3,579,886 A * 5/1971 Hughes ..... G09F 1/12 40/781
3,700,159 A * 10/1972 Beigel ..... B65D 5/32 229/101
D229,708 S 12/1973 Dugan-Chapman
4,184,602 A * 1/1980 Moliard ..... C05F 17/907 220/8
4,302,013 A * 11/1981 Kavis ..... A63F 9/1044 273/157 R
4,356,650 A * 11/1982 Antonczyk ..... B44C 5/02 40/800
4,432,152 A * 2/1984 Daenen ..... A47G 1/162 40/781
4,436,307 A * 3/1984 Caldwell ..... A63F 9/1044 273/157 R
4,479,651 A * 10/1984 LaFleur ..... A63F 9/1044 273/DIG. 30
4,486,018 A * 12/1984 Keller, Jr. ..... A63F 9/1044 220/377
4,532,727 A * 8/1985 Klose ..... A47G 1/065 40/729
4,687,202 A * 8/1987 Palma ..... A63F 9/10 273/157 R
4,705,275 A * 11/1987 Slater ..... A63F 9/1044 273/148 R
4,741,534 A * 5/1988 Rogahn ..... G09F 7/04 40/907
4,865,325 A * 9/1989 Stolz ..... A63F 9/1044 273/157 R
4,936,033 A * 6/1990 Lacko ..... A47G 1/06 40/611.01
4,984,798 A * 1/1991 Silberstein ..... A63F 9/1044 40/781
5,016,772 A * 5/1991 Wilk ..... B65D 21/086 220/495.11
5,020,251 A * 6/1991 Cheng ..... A47G 1/065 40/748
5,075,991 A * 12/1991 Wenkman ..... A47G 1/06 40/781
D328,390 S * 8/1992 MacDonald ..... D3/270
5,172,504 A * 12/1992 De Maat ..... G09F 15/0068 40/605
5,244,212 A * 9/1993 Bendit ..... A63F 3/02 273/285
5,249,802 A * 10/1993 McCarthy ..... A63F 9/1044 273/DIG. 30
5,529,173 A * 6/1996 Salacuse ..... B65D 75/22 206/315.1
5,582,313 A * 12/1996 Envall ..... B60R 9/055 312/265.5
5,588,240 A * 12/1996 Zilliox ..... G09F 1/12 40/605
5,624,118 A * 4/1997 Gottesman ..... A63F 9/1044 40/739
D379,380 S * 5/1997 Delaney ..... D21/485
5,651,547 A * 7/1997 Rannelli ..... A63F 9/1044 273/157 R
5,765,707 A 6/1998 Kenevan
5,809,905 A * 9/1998 John ..... B65D 19/0075 108/56.1
5,840,377 A * 11/1998 Donnell ..... A63F 9/001 428/33
5,871,212 A 2/1999 Lee
6,167,680 B1 * 1/2001 Horn ..... B65D 25/04 220/4.23
6,386,381 B2 * 5/2002 Csiszar ..... B65D 21/083 220/4.03
6,447,079 B1 * 9/2002 Irwin ..... A47G 1/12 312/118
7,552,821 B1 * 6/2009 Demers ..... A63F 9/1044 206/499
7,584,562 B2 * 9/2009 Youn ..... G09F 9/3026 40/605
8,365,452 B2 * 2/2013 Goldman ..... A47G 1/065 40/781
8,523,204 B2 * 9/2013 Chen ..... B62B 5/0093 280/87.021
8,844,739 B2 * 9/2014 Holey ..... B65D 81/263 229/101
D747,134 S 1/2016 Annunziata
9,345,953 B2 * 5/2016 Chuang ..... A63F 3/0423
9,884,702 B1 * 2/2018 Burns ..... A63C 11/00
10,939,774 B2 * 3/2021 Coyle, Jr. ..... A47G 1/06
D972,650 S 12/2022 Starkey
D972,933 S 12/2022 Maeda
D1,006,123 S 11/2023 Zhou
2007/0266911 A1 * 11/2007 Lee ..... A63F 9/1044 108/60
2008/0157468 A1 * 7/2008 Dedrick ..... A63F 9/10 273/153 R
2012/0024729 A1 * 2/2012 Dietenberger ..... A63F 9/10 206/315.1
2014/0014540 A1 * 1/2014 Weldring ..... A63F 9/1044 206/315.1
2020/0190837 A1 6/2020 Xia
2021/0153643 A1 5/2021 Haddy
2021/0252381 A1 * 8/2021 Paulhamus ..... A63F 9/1044
2022/0258040 A1 8/2022 De Cianni
2023/0347235 A1 11/2023 Zhou

FOREIGN PATENT DOCUMENTS

GB 2210800 A * 6/1989 ..... A63F 9/1044
GB 2423729 9/2006
GB 2473706 A 3/2011
JP H0521992 U * 3/1993
WO 1999022828 5/1999
WO 1999022828 A1 5/1999
WO WO-2005023387 A1 * 3/2005 ..... A63F 3/00694

OTHER PUBLICATIONS

AU2022200963—Examination_Report_No. 2—Australian Patent Office, Mar. 28, 2023.
AU2022200963—Examination_Report_No. 3—Australian Patent Office, Apr. 20, 2023.
AU2022200963—Notice_of_Acceptance_and_Bibliographic_Attachment—Australian Patent Office, Jun. 20, 2023.
Puzzle Board, available on Amazon.com, oldest customer review with photo Oct. 7, 2020, [site visited Nov. 24, 2023], URL: https://www.amazon.com/Tektalk-Portable-Dustproof-Storage-Non-Slip/dp/B086GQV6X7 (Year: 2020).
Portable Puzzle Case, available on Amazon.com, oldest customer review with photo Dec. 7, 2020, [site visited Nov. 24, 2023], URL: https://www.amazon.com/Portable-Stowaway-Puzzles-Accessories-Non-Sli p/dp/B08 LZ7 H F4C (Year: 2020).

(56) References Cited

OTHER PUBLICATIONS

Foldable Puzzle Board, available on Amazon.com, oldest customer review with photo Oct. 17, 2022, [site visited Nov. 24, 2023], URL: https://www.amazon.com/Hula-Home-Puzzle-Board-30/dp/B09XJGK9D8 (Year: 2022).
White Puzzle Tray, available on Amazon.com, oldest customer review Oct. 25, 2020, [site visited Nov. 24, 2023], URL: https://gratefulhouse.com/shop/puzzle-tray/white-puzzle-tray/ (Year: 2020).

* cited by examiner

PUZZLE CASE

TECHNICAL FIELD

The present invention relates to a puzzle case with an integrated mounting function.

BACKGROUND ART

Jigsaw puzzles are a form of entertainment or mental challenge. Some jigsaw puzzles are highly complex and completing the jigsaw provides the user a sense of achievement. Once the puzzle is completed it is either stored back in the container it came in or can be placed into a bespoke jigsaw puzzle container. There are no jigsaw puzzle containers with the ability to store the final product in a case that can be mounted and displayed or within which the puzzle can be built. Commonly this would be undertaken by using a picture frame.

The object of this invention is to provide a puzzle case to address the above shortcomings or at least to provide a useful alternative.

SUMMARY OF THE INVENTION

In an aspect of the invention there is provided a puzzle case comprising a top panel defined by several top sections adapted to be removably connected together; a base panel defined by several bottom sections adapted to be removably connected together; the top panel adapted to engage the base panel and define a cavity thereinbetween allowing a jigsaw puzzle to be placed therein.

In preference the top panel is transparent.

In preference the base panel includes of structural reinforcements such as ribs.

In preference the top panel and the base panel are adapted to be removably attached to each other using clips.

In preference each panel comprises of comprising four sections.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will refer to several drawings as follows.

DETAILED DESCRIPTION

Figure 1:
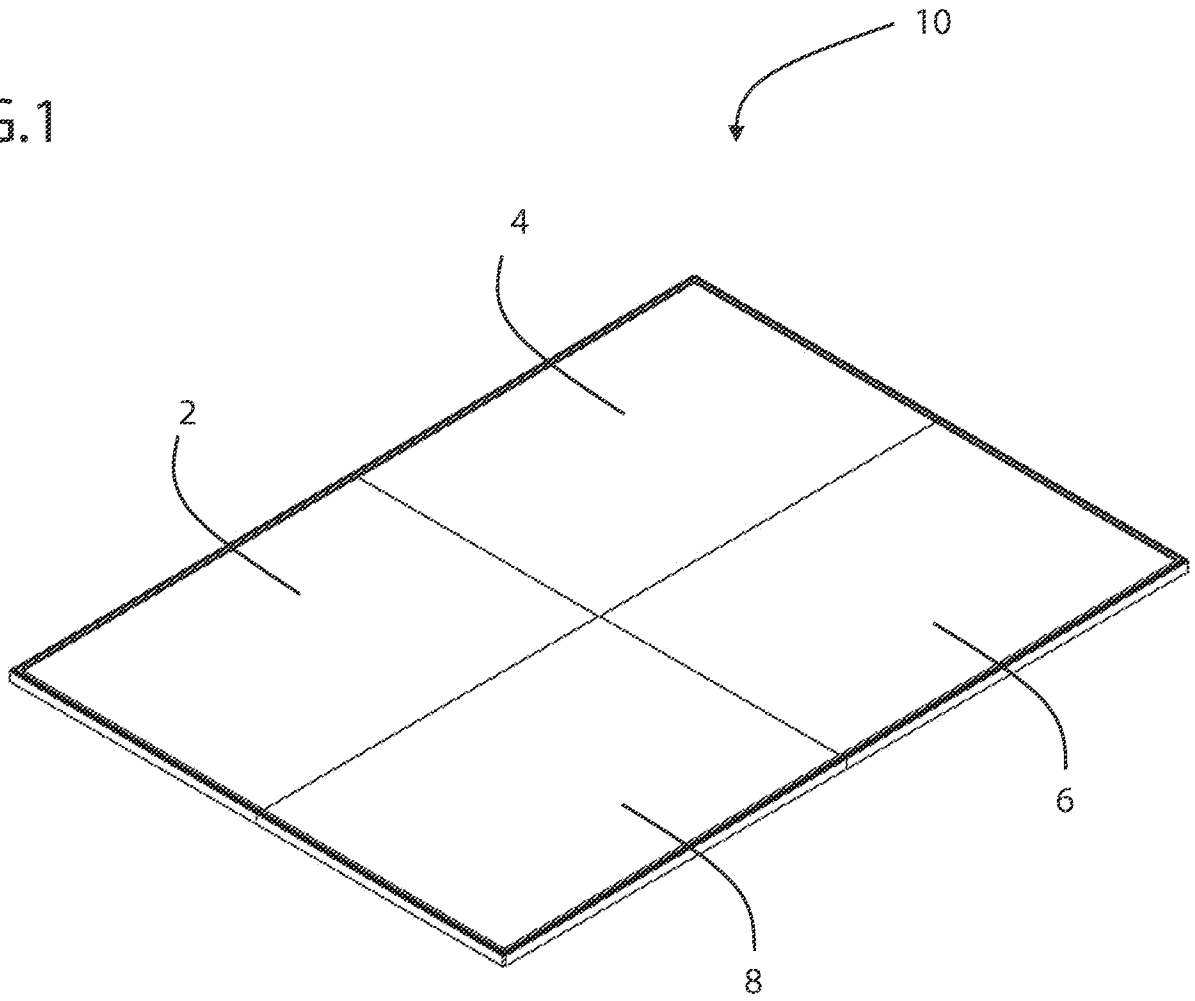
FIG. 1 illustrates a completed puzzle case fully assembled including a top panel and a base panel.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Figure 2:
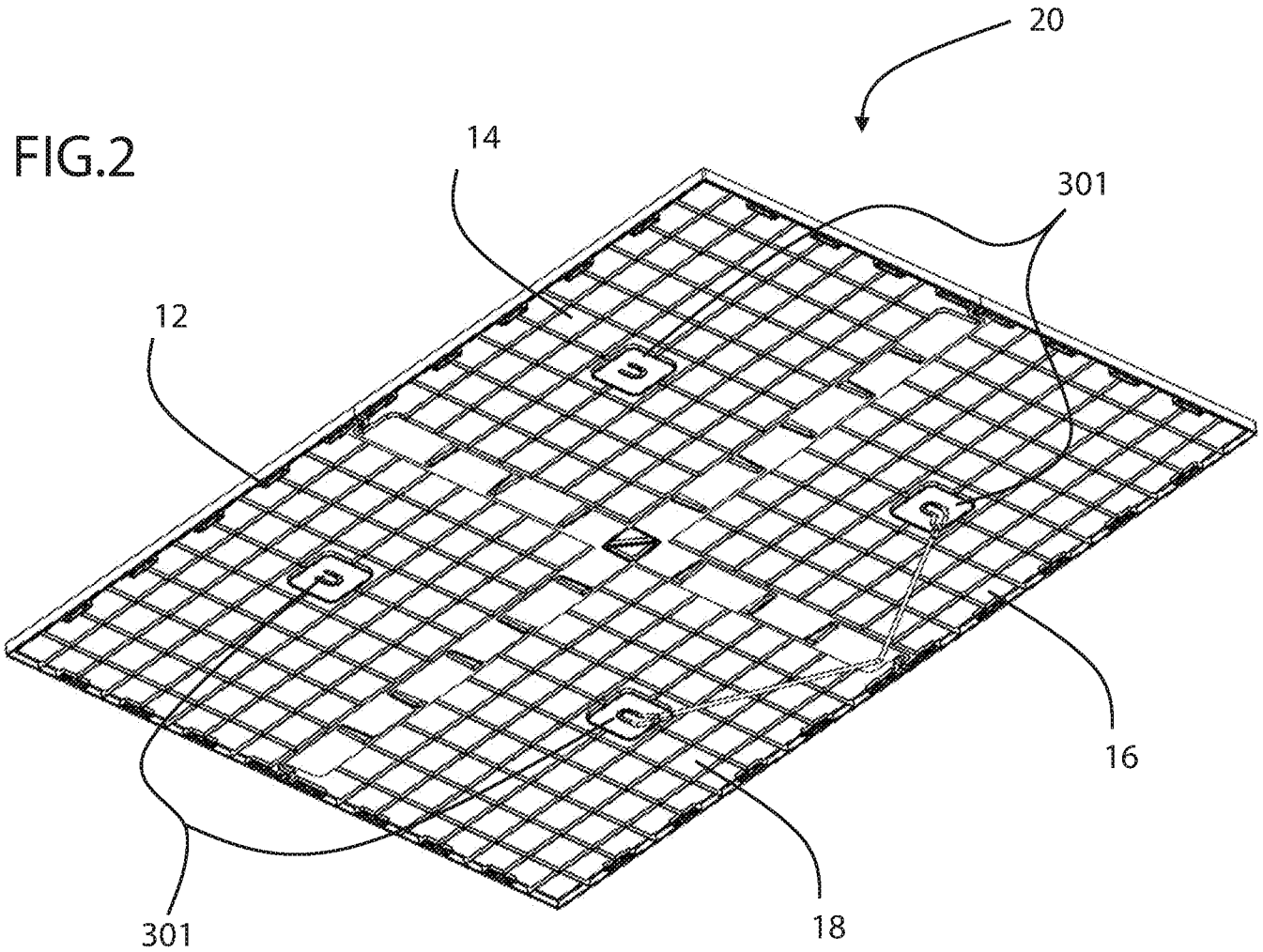
FIG. 2 is a bottom perspective view of the puzzle case.
Figure 3:
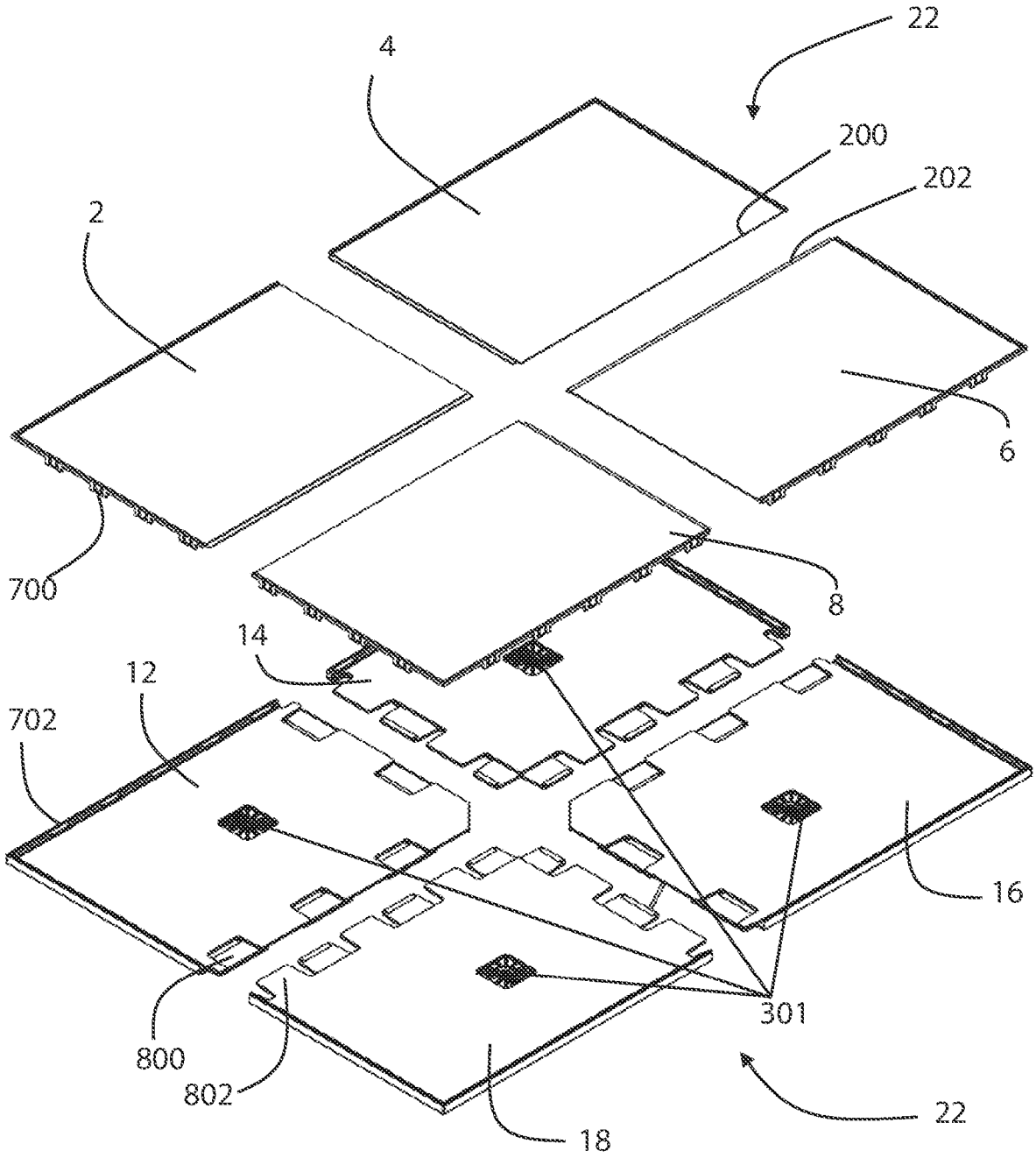
FIG. 3 is an exploded view of the puzzle case.

Referring to FIGS. 1-3, a puzzle case 10 comprises eight sub-sections. It is however not limited to having eight sub-sections.

The puzzle case 10 with optional mounting accessories comprises of top sections 2, 4, 6, and 8 and at least one clip 700 extending downwardly at an edge of each top section. A base panel 20 comprises bottom sections 12, 14, 16, and 18, and at least one clip hole or aperture 702 located on the edge of each bottom section where the corresponding clip on the top panel can engage the corresponding clip hole. A mounting point 301 on the back of the base panel that can be used for hanging the puzzle container for display.

The bottom sections 12, 14, 16, 18 are connected into a single base panel 20. The bottom sections 12, 14, 16, 18 are connected to each other by interlocking male clips 800 that engage females clips 802 by pushing them together as shown in FIG. 2.

Figure 4:
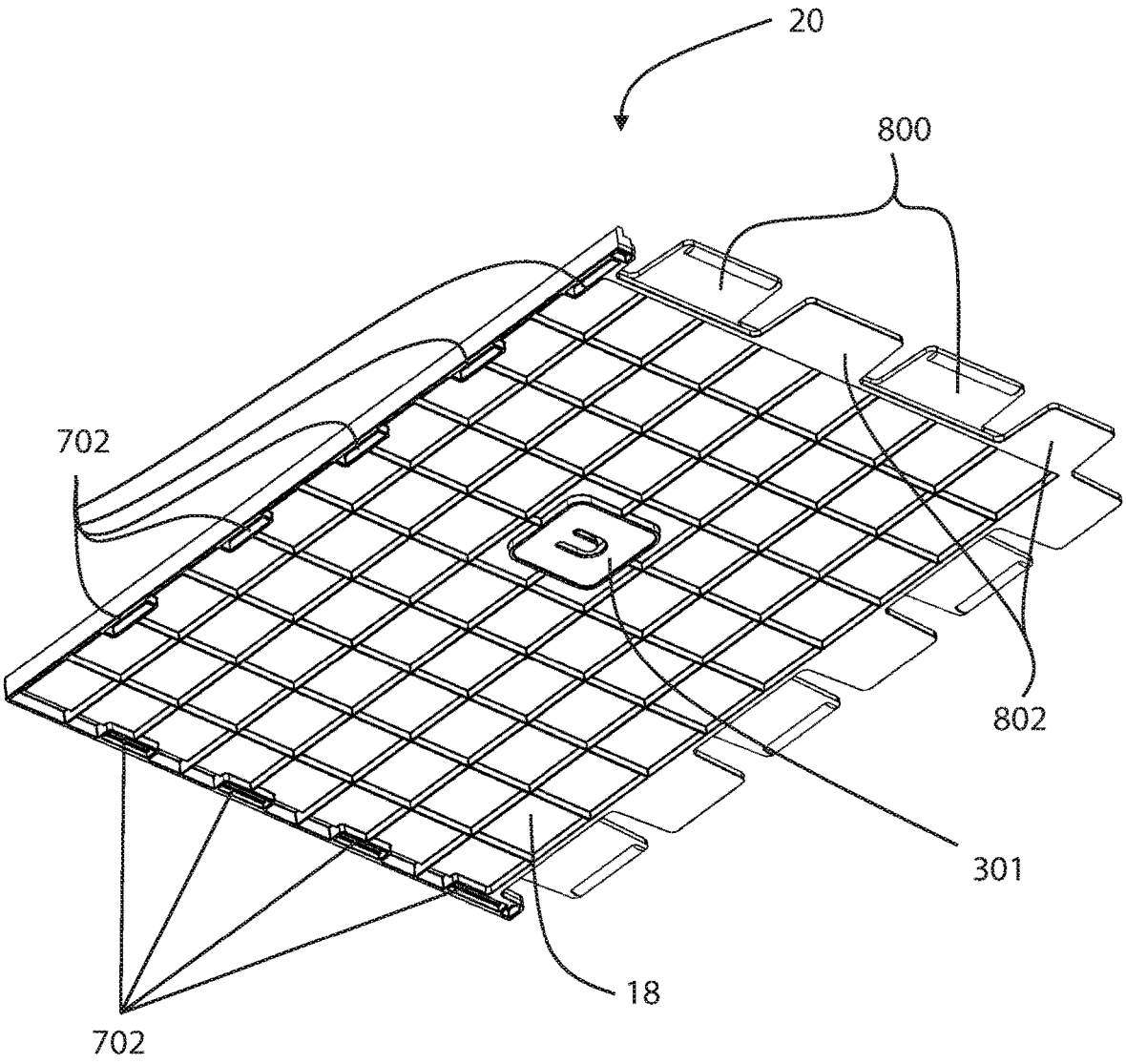
FIG. 4 is an underside view of the base panel.

The male 800 and female 802 clips are located on the inner edge of each of the bottom sections 12, 14, 16, 18. The inner edge of the bottom section has at least one male 800 and one female 802 clip that are collocated to each other on the opposing panel. FIG. 4 displays one arrangement of the clips 800, 802 on the inner edge. It is to be understood that there may be many solutions to how the bottom sections are connected and it is not intended to limit the present invention to this particular embodiment.

The outer edges of the bottom sections comprise female clip holes 702 that are collocate to the top panel's outer edge male clips 700.

Figure 5:
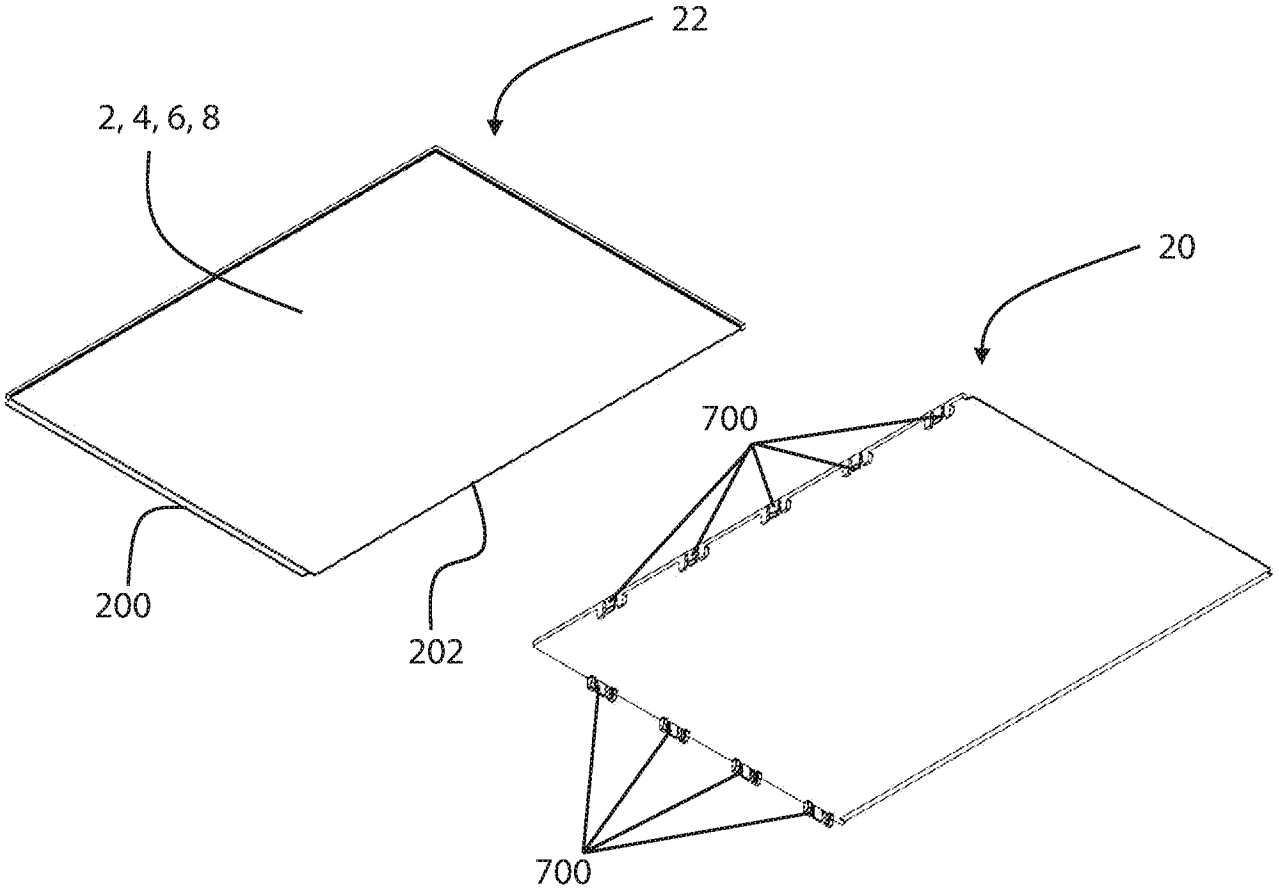
FIG. 5 is an upper and underside view of the panels.

The bottom sections 12, 14, 16, 18 include an upper surface that is flat and smooth for the puzzle to rest on. The underside of the bottom sections 12, 14, 16, 18 have a surface with a ribbed extrusion in a grid pattern that adds strength to the panel preventing it from flexing (FIGS. 2, 4). In the centre of each of the bottom sections, a mounting point 301 is located. The mounting point 301 is square in shape and located on the rear of the base panel (FIG. 4), in the centre of the square is a D shape hook. The D shape hook is surrounded by ribbed extrusions that help strengthen the plate as shown in FIG. 5. It is not intended to limit the invention to having mounting points.

After the bottom sections 12, 14, 16, 18 are connected to form a single base panel 20, the jigsaw puzzle can be placed on top of the base panel 20. Of course, the jigsaw puzzle may be constructed within the base panel 20.

The top panel 22 is assembled by interlocking each of the top sections 2, 4, 6, and 8 together. Each top section 2, 4, 6, 8 comprises an inner lip 200. The inner lip 200 is the full length of one inner panel edge and is designed to accept an opposing panel's lip 202 by either going over or under the opposing lip 200, 202. Thus alternating sections will have alternate configuration of the opposing lips.

The top sections 2, 4, 6, 8 are connected by pushing together the inner lips 200,202. The inner lips 200, 202 hold the top sections together to form one top panel 22. Other ways of connecting the sections together would be able to be designed by the relevant person skilled in the art.

Once the top sections are connected into one piece, the top panel 22 can engage the base panel 20. A very thin cavity exists between the top and bottom panels when connected which allows a puzzle to effectively be clamped between the two when finished. The space may only be a few mm in depth, depending on the thickness of the jigsaw puzzle pieces. The outer edges of the top sections 2, 4, 6, 8 comprise male locking clips 700 that fix into the collocated bottom section's female clip holes 702 on the base panel 20.

Once the top panel 22 and the bottom panel 20 are connected and form the completed puzzle panel 10, the puzzle case 10 can be stored or hung up for display using the mounting points 301.

The bottom sections 12, 14, 16, 18 and top sections 2, 4, 6, 8 are made of suitable plastic material with the top sections being transparent to allow for the viewing of the jigsaw. material.

On the back of the bottom sections 12, 14, 16, 18 there are various methods that can used to hang the base panel on a structure for display. Firstly, there may be plug holes 301 located on the back of each of the bottom sections 12, 14, 16, 18. The mounting points 301 have a D shaped hook that extends downwardly, the D shape providing a fastener point to mount the base panel onto a structure such as a wall or post. The hook can also be used to attach a string, wire, or rope to allowing the base panel to be hung on a nail. Secondly, the base panel can be stuck to a structure with double-sided adhesive tape by applying it to the flat sections of the base panel.

The puzzle case can be dismantled by unclipping the panel clips 700, the clips 700 being disengaged by forcing them out of the base panel's clip holes 702.

When all the clips have been disengaged, they will allow the top panel 22 and the base panel 20 to be separated.

It is to be understood that the number of sections may vary as well as their geometry. But typically, there will be four top sections and four bottom sections that will provide an effective space to hold a completed jigsaw puzzle. Again, we reiterate that the engagement of each section as well as the engagement of the top and base panels may be accomplished by various means and the above description is not intended to limit the invention to this embodiment.

The reader will now appreciate the present invention which provides a puzzle protection case. A further advantage is that the size of the panels allows them to be packed into a box that includes the puzzle pieces. Thus the user can purchase a jigsaw puzzle that includes sections that can be assembled together to provide support for the puzzle.

LIST OF COMPONENTS

The drawings include the following integers.

2, 4, 6, 8 top sections
10 puzzle case
12, 14, 16, 18 bottom sections
20 base panel
22 top panel
200 inner lip
202 opposing lip
301 mounting point
700 male locking clips
702 female clip holes
800 interlocking male clip
802 female clip Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A puzzle case comprising:

a top panel which is transparent, wherein the top panel comprises a plurality of top sections configured to be removably connected to one another;

a bottom panel comprising a plurality of bottom sections configured to be removably connected to one another;

outer edge walls provided on the bottom panel and extending upwardly beyond an upper surface of the bottom panel, wherein an area of the upper surface of the bottom panel is adapted to receive jigsaw puzzle pieces thereon;

wherein the top panel is operatively engageable with the bottom panel around an outer perimeter of the bottom panel;

a cavity defined by the top panel and the bottom panel when operatively engaged with one another;

wherein the outer edge walls encircle the cavity when the puzzle case is assembled;

a plurality of clips, wherein the top panel and the bottom panel are removably attached to one another using the plurality of clips; and wherein the cavity of the puzzle case has a depth which is sufficient to receive an assembled jigsaw puzzle within the cavity and which enables the assembled jigsaw puzzle to be clamped between the top panel and the bottom panel and to be displayed through the top panel.

2. The puzzle case as in claim 1, wherein the bottom panel includes structural reinforcements.

3. The puzzle case as in claim 1, wherein the bottom panel includes ribs.

4. The puzzle case as in claim 1, wherein the top panel comprises four top sections and the bottom panel comprises four bottom sections.

5. The puzzle case as in claim 1, wherein the outer edge walls are of a height adapted to correspond to a thickness of the jigsaw puzzle receivable therein.

6. The puzzle case as in claim 1, wherein the plurality of bottom sections is opaque.

7. The puzzle case as in claim 1, further comprising at least one mounting point provided on a rear surface of the bottom panel, wherein the at least one mounting point is adapted to enable securement of the puzzle case to a vertical surface.

8. The puzzle case as in claim 1, wherein the cavity is of a depth small enough to clamp a finished jigsaw puzzle between the top panel and the bottom panel.

* * * * *